US006475304B2

(12) United States Patent
Toda et al.

(10) Patent No.: US 6,475,304 B2
(45) Date of Patent: Nov. 5, 2002

(54) GRAIN-ORIENTED SILICON STEEL SHEET AND PROCESS FOR PRODUCTION THEREOF

(75) Inventors: Hiroaki Toda, Kurashiki (JP); Kunihiro Senda, Okayama (JP); Mitsumasa Kurosawa, Okayama (JP); Makoto Watanabe, Okayama (JP); Atsuhito Honda, Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/908,269

(22) Filed: Jul. 18, 2001

(65) Prior Publication Data

US 2002/0000265 A1 Jan. 3, 2002

Related U.S. Application Data

(62) Division of application No. 09/398,586, filed on Sep. 17, 1999, now Pat. No. 6,287,392.

(30) Foreign Application Priority Data

Sep. 18, 1998 (JP) ..... 10-264765
Jun. 15, 1999 (JP) ..... 11-168317

(51) Int. Cl.[7] ..... H01F 1/18
(52) U.S. Cl. ..... 148/308; 148/307
(58) Field of Search ..... 148/307, 308; 420/117

(56) References Cited

U.S. PATENT DOCUMENTS

| | | | | |
|---|---|---|---|---|
| 4,797,167 A | | 1/1989 | Nakayama et al. | |
| 4,824,493 A | | 4/1989 | Yoshitomi et al. | |
| 5,066,343 A | | 11/1991 | Nakashima et al. | |
| 5,330,586 A | | 7/1994 | Komatsubara et al. | |
| 6,103,022 A | * | 8/2000 | Komatsubara et al. | 148/308 |
| 6,228,182 B1 | * | 5/2001 | Nakano et al. | 148/111 |

FOREIGN PATENT DOCUMENTS

| | | | | |
|---|---|---|---|---|
| EP | 0761 827 A2 | | 9/1996 | |
| EP | 0 869 190 A1 | | 10/1998 | |
| JP | 63-200504 | * | 8/1988 | 148/307 |
| JP | 03087316 | | 4/1991 | |
| JP | 06346203 | | 12/1994 | |
| JP | 08269572 | | 10/1996 | |
| JP | 09279247 | | 10/1997 | |

* cited by examiner

*Primary Examiner*—John Sheehan
(74) *Attorney, Agent, or Firm*—Schnader Harrison Segal & Lewis LLP

(57) ABSTRACT

Grain-oriented silicon steel sheet with Bi as an auxiliary inhibitor and a forsterite coating film having a Cr spinel oxide subscale of $FeCr_2O_4$ or $Fe_xMn_{1-x}Cr_2O_4$ ($0.6 \leqq x \leqq 1$), made from a steel slab containing 0.005–0.20 wt % of Bi and 0.1–1.0 wt % of Cr.

4 Claims, 4 Drawing Sheets

GRAIN-ORIENTED SILICON STEEL SHEET AND PROCESS FOR PRODUCTION THEREOF

This application is a division out of parent application Ser. No. 09/398/586, filed Sep. 17, 1999, now U.S. Pat. No. 6,287,392, granted Sep. 11, 2001.

BACKGROUND OF THE INVENTION

1. Field of the Invention

The present invention relates to a grain-oriented silicon steel sheet suitable for use as the iron core of transformers and other electric machines, and also to a process for producing the same. The silicon steel sheet possesses both good coating properties and good magnetic properties.

2. Description of the Related Art

Grain-oriented silicon steel sheets are used mainly as a material of the iron core of transformers and rotating machines. They are required to have such magnetic properties as high magnetic flux density, low iron loss, and small magnetostriction. Nowadays, there is an increasing demand for grain-oriented silicon steel sheets superior in magnetic properties from the standpoint of energy saving and material saving.

In the production of grain-oriented silicon steel sheets superior in magnetic properties, it is important that the resulting product has a structure such that the grains of secondary recrystallization are densely arranged along the (110)[001] orientation or so-called Goss orientation.

Grain-oriented steel sheets as mentioned above are produced by the following steps. First, grain-oriented silicon steel slabs are produced which contain MnS, MnSe, AlN, BN, or the like as an inhibitor necessary for secondary recrystallization. After heating, they undergo hot rolling. The resulting hot-rolled sheets undergo annealing, if necessary, and then undergo cold rolling (down to the final thickness) once or twice or more, with any intermediate annealing interposed. The cold-rolled sheets undergo decarburization annealing. With an annealing separator (composed mainly of MgO) coated, the steel sheets undergo final finishing annealing.

The grain-oriented silicon steel sheets obtained in this manner usually have their surfaces coated with an insulating film composed mainly of forsterite ($Mg_2SiO_4$) (which is simply referred to as "forsterite coating" hereinafter). This forsterite coating gives the steel sheets not only surface electrical insulation but also tensile stress resulting from low thermal expansion. Therefore, it improves iron loss as well as magnetostriction.

After final finishing annealing, grain-oriented silicon steel sheets are usually given a vitreous insulating coating (simply referred to as glass coating hereinafter) on the forsterite coating. This glass coating is very thin and transparent. Therefore, it is forsterite coating rather than glass coating that eventually determines the external appearance of the product. In other words, the appearance of forsterite coating greatly affects the product value. For example, any product would be regarded as inadequate if it had forsterite coating formed such that the base metal is partly exposed. Thus, the properties of forsterite coating seriously affect the product yields. That is, forsterite coating is required to have an uniform appearance without flaws, and with good adhesion to prevent peeling at the time of shearing, punching, and bending. Moreover, forsterite coating is required to have a smooth surface because the steel sheets laminated to form the iron core need to have a high space factor.

There have been disclosed various technologies to improve the magnetic properties of grain-oriented silicon steel sheets. One of them involves the use of an auxiliary inhibitor that makes up for the function of the main inhibitor such as MnS, MnSe, AlN, and BN. Among the known elements which function as auxiliary inhibitors are Sb, Cu, Sn, Ge, Ni, P, Nb, V, Mo, Cr, Bi, As, and Pb. Of these elements, Bi is known to give a much higher magnetic flux density than before (For example, Japanese Patent Publication Nos. 32412/1979 and 38652/1981, Japanese Patent Re-publication No. 814445/1990, Japanese Patent Laid-open Nos. 88173/1994 and 253816/1996). However, adding Bi to steel presents difficulties in producing good forsterite coating at the time of finishing annealing. Products with poor coating are usually rejected.

Forsterite coating is formed at the time of final finishing annealing. The formation of forsterite coating affects the decomposition of inhibitors (such as MnS, MsSe, and AlN) in steel. In other words, it also affects the secondary recrystallization which is an essential step to obtain good magnetic properties. In addition, forsterite coating absorbs the components of inhibitor which become unnecessary after the completion of secondary recrystallization, thereby purifying steel. This purification also contributes to improvement in the magnetic properties of steel sheets.

Consequently, forming a uniform forsterite coating by controlled steps is very important to obtain grain-oriented steel sheets with good magnetic properties.

Forsterite coating is usually formed by the following steps. First, a grain-oriented silicon steel sheet which has been cold-rolled to a desired final thickness is annealed in wet hydrogen atmosphere at 700–900° C. This annealing is called decarburization annealing. It has the following functions.

(1) To subject the texture (after cold rolling) to the primary recrystallization so that the secondary recrystallization takes place adequately in the final finishing annealing.

(2) To reduce the content of C in cold-rolled steel sheets from about 0.01–0.10 wt % to about 0.003 wt % or less so as to protect the magnetic properties of the product from aging deterioration.

(3) To cause subscale (containing $SiO_2$) to form in the surface layers of steel sheets by oxidation of Si that is present in steel.

After decarburization annealing, the steel sheet is coated with an annealing separator (composed mainly of MgO) and then coiled. The coil undergoes final finishing annealing (which serves also for secondary recrystallization and purification) in a reducing or non-oxidizing atmosphere at about 1200° C. (maximum). Forsterite coating is formed on the surface of steel sheet according to the solid-phase reaction shown by the following formula.

$$2MgO+SiO_2 \rightarrow Mg_2SiO_4$$

Forsterite coating is a ceramic coating densely composed of fine crystalline particles about 1 $\mu$m in size. As the formula shows, one raw material of forsterite coating is subscale containing $SiO_2$ which has formed in the outer layer of the steel sheet at the time of decarburization annealing. Therefore, the kind, amount, and distribution of subscale are deeply associated with the nucleation and grain growth of forsterite coating. They also greatly affect the strength of grain boundary and grain of coating crystals and further affect the quality of coating after final finishing annealing.

The annealing separator (composed mainly of MgO as another raw material) is applied to the steel sheet in the form of an aqueous slurry. Therefore, steel sheets retain physically adsorbed water even after drying, and MgO partly hydrates to form $Mg(OH)_2$. As the result, steel sheets continue to give off water (although small in quantity) until the temperature reaches about 800° C. during final finishing annealing. This water oxidizes the surface of the steel sheet during final finishing annealing. The oxidation by water also affects the formation of any forsterite coating and the behavior of inhibitors. Added oxidation by water is a factor tending to deteriorate magnetic properties. In addition, the ease with which oxidation by water takes place depends greatly on the physical properties of subscale formed by decarburization annealing.

Also, any additives other than MgO incorporated into the annealing separator, however small in quantity, greatly affect the film formation as a matter of course.

In the case of grain-oriented silicon steel sheets having a nitride inhibitor (such as AlN and BN), the physical properties of subscale greatly affect the behavior of denitrification during finishing annealing or the behavior of nitrification from the annealing atmosphere. Therefore, the physical properties of subscale greatly affect the magnetic properties of the sheet.

As mentioned above, controlling the physical properties of subscale formed in the outer layer of steel sheets during decarburization annealing, controlling the properties of magnesia in the annealing separator, and controlling the kind of additive in the annealing separator are three factors indispensable in forming forsterite coatings of uniform good quality at a prescribed annealing temperature which is determined by the condition of secondary recrystallization in finishing annealing. They are very important in the production of grain-oriented steel sheets.

Incidentally, if the steel does not contain Bi, forsterite coating of good quality may be formed by any of the disclosed techniques given below.

Japanese Patent Laid-open No. 185725/1984, controlling the oxygen content in steel sheets after decarburization annealing.

Japanese Patent Publication No. 1575/1982, keeping the degree of oxidation in the atmosphere at 0.15 and above in the front region of decarburization annealing and at 0.75 and below in the rear region that follows.

Japanese Patent Laid-open No. 240215/1990 and Japanese Patent Publication No. 14686/1979, performing heat-treatment at 850–1050° C. in a non-oxidizing atmosphere after decarburization annealing.

Japanese Patent Publication No. 57167/1991, cooling after decarburization annealing in such a way that the degree of oxidation is lower than 0.008 in the temperature region below 750° C.

Japanese Patent Laid-open No. 336616/1994, performing heat treatment in such a way that the ratio of the partial pressure of water vapor to the partial pressure of hydrogen is lower than 0.70 in soaking step and the ratio of the partial pressure of water vapor to the partial pressure of hydrogen in the heating step is lower than that in the soaking step.

Japanese Patent Laid-open No. 278668/1995, prescribing the rate of heating and the atmosphere of annealing.

Forsterite coating looks poor if the base metal is exposed sporadically. This defect can be avoided by the method disclosed in Japanese Patent Laid-open No. 226115/1984, which consists of causing the raw material to contain 0.003–0.1 wt % of Mo and performing decarburization annealing at 820–860° C. such that the degree of oxidation in the atmosphere is 0.30–0.50 expressed as $P(H_2O)/P(H_2)$, and the subscale formed on the surface of steel sheet is composed of silica ($SiO_2$) and fayalite ($Fe_2SiO_4$), with the ratio of $Fe_2SiO_4/SiO_2$ being in the range of 0.05–0.45.

Apart from the above-mentioned techniques relating to decarburization annealing, there have been proposed a number of techniques for improving the characteristic properties of the coating film. These techniques involve the addition of a Ti compound (such as $TiO_2$), as an additive other than magnesia, to the annealing separator. For example, Japanese Patent Publication No. 12451/1976 discloses a method of improving the uniformity and adhesion of forsterite coating by incorporating 100 pbw of Mg compound with 2–40 pbw of Ti compound. Japanese Patent Publication No. 15466/1981 discloses a method of eliminating black spots from the Ti compound by finely grinding $TiO_2$ for the annealing separator. Japanese Patent Publication No. 32716/1982 discloses a method of adding an Sr compound in an amount of 0.1–10 pbw (as Sr) so as to form forsterite insulating film with good adhesion and good uniformity.

Also, there have been disclosed several methods for improving the magnetic properties by adding a compound to the separator. Japanese Patent Publication No. 14567/1979 discloses the addition of Cu, Sn, Ni, or Co, or a compound thereof in an amount of 0.01–15 pbw (as metallic element). Japanese Patent Laid-open No. 243282/1985 discloses the addition of $TiO_2$ or TiO (0.5–10 pbw) and SrS, SnS, or CuS (0.1–5.0 pbw), together with optional antimony nitrate (0.05–2.0 pbw).

Moreover, Japanese Patent Laid-open No. 291313/1997 discloses a method of improving both the magnetic properties and the film characteristics of the silicon steel product sheet. This method is based on the result of investigation on the relation between the subscale (which occurs at the time of decarburization annealing) and the annealing separator. The object is achieved by adjusting the partial pressure of hydrogen ($P(H_2)$) and the partial pressure of water vapor ($P(H_2O)$) in decarburization annealing such that the ratio of $P(H_2O)/P(H_2)$ in the soaking step is lower than 0.70 and the ratio of $P(H_2O)/P(H_2)$ in the heating step is lower than that in the soaking step, and also by incorporating 100 pbw of MgO in the annealing separator with 0.5–15 pbw of $TiO_2$, 0.1–10 pbw of $SnO_2$, and 0.1–10 pbw of Sr compound (as Sr).

There have been proposed other techniques developed, with attention paid to the amount of subscale in steel sheets which have undergone decarburization annealing. For example, Japanese Patent Laid-open Nos. 329829/1992 and 329830/1992 disclose a method of adding Cr and Sb simultaneously or adding Cr, Sn, and Sb simultaneously, thereby minimizing the fluctuation of the amount of oxidized layer and forming the coating film stably in finishing annealing. Japanese Patent Laid-open No. 46297/1989 discloses a method of making fayalite ($Fe_2SiO_4$) and silica ($SiO_2$) thick enough for the formation of forsterite coating by adding Cr and establishing adequate conditions for decarburization annealing so as to promote diffusion of oxygen in the thickness direction.

Unfortunately, incorporating steel with Bi suffers difficulties in obtaining a good forsterite coating at the time of finishing annealing (which results in unacceptable products with poor coating film). In connection with this, Japanese Patent Laid-open No. 202924/1997 mentions that "it is assumed that Bi vapor concentrated between steel sheets adversely affects the formation of primary coating, thereby making it difficult to form good primary coating film." Incidentally, this Japanese Patent discloses a method of increasing the magnetic flux density by the addition of Bi and also providing a material with low iron loss. (This method is based on the above-mentioned assumption.)

Even in the case of Bi-containing steel, good forsterite coating can be obtained by any of the methods disclosed as follows.

Japanese Patent Laid-open No. 232019/1996, adjusting the amount of oxygen in oxide film after decarburization annealing to 600–900 ppm and applying an annealing separator incorporated with 0.01–0.10 pbw of chlorine compound (as Cl) and/or 0.05–2.0 pbw of one kind or more than one kind of Bb, B, Sr, and Ba compounds, for 100 pbw of MgO.

Japanese Patent Laid-open No. 258319/1996, adjusting the amount of annealing separator (composed mainly of MgO) to 5 $g/m^2$ or above on one side of steel sheet.

Japanese Patent Laid-open No. 111346/1997, adjusting the flow rate of atmosphere gas in finishing annealing such that the ratio of flow rate to the total surface area of steel strip is equal to or larger than 0.002 ($Nm^3/hm^2$).

Japanese Patent Laid-open No. 25516/1998, adjusting the Ig-loss value of magnesia in the annealing separator to 0.4–1.5 wt %.

Japanese Patent Laid-open No. 152725/1998, adjusting the amount of oxygen on the surface of steel sheet after decarburization annealing to 550–850 ppm.

Incidentally, the Ig-loss value is hydrate amount calculated by the weight difference between before and after baking process of making magnesia.

The above-mentioned techniques, however, do not basically change the reaction to form forsterite in the presence of Bi (or do not promote the forsterite reaction $2MgO+SiO_2 \rightarrow Mg_2SiO_4$). In other words, they do not improve forsterite coating satisfactorily, or they cannot stably form defect-free, uniform forsterite coating of good quality and good adhesion over the entire width and length of a coil product.

SUMMARY OF THE INVENTION

It is an object of the present invention to provide grain-oriented steel sheets superior in magnetic properties, having defect-free, uniform forsterite coating with good adhesion over the entire width and length of a coil even though the steel contains Bi in an amount of about 0.005–0.2 wt %.

The sheet has superior coating properties and magnetic properties. The process includes a series of steps of hot-rolling a silicon steel slab containing about C: 0.030–0.12 wt %, Si: 2.0–4.5 wt %, acid-soluble Al: 0.01–0.05 wt %, N: 0.003–0.012 wt %, Mn: 0.02–0.5 wt %, and Bi: 0.005–0.20 wt %, cold-rolling the hot-rolled sheet once or twice or more with intermediate annealing interposed, performing decarburization annealing to the final cold rolled sheet, applying an annealing separator to the surface of the decarburized steel sheet, and performing final finishing annealing consisting of secondary recrystallization annealing and purifying annealing to the separator-applied sheet, characterized in that the steel slab contains about 0.1–1.0 wt % of Cr so that a Cr spinel oxide is formed in the subscale oxide film in the surface layer of the resulting steel sheet when subjected to decarburization annealing.

In the above-mentioned process, the decarburization annealing may be accomplished in such a way that the decarburizing soaking temperature is about 800–900° C. and the annealing temperature is increased at an average rate of about 10–50° C./s from the starting temperature to 700° C. and then the temperature is raised at an average rate of 1–9° C./s from (soaking temperature −50° C.) to the soaking temperature.

In the above-mentioned process, the subscale Cr spinel oxide in the oxide film may be composed mainly of $FeCr_2O_4$ or $(Fe,Mn)Cr_2O_4$ or mixtures thereof.

In the above-mentioned process, the decarburization annealing may be accomplished in such a way that the amount of oxygen in the surface layer of steel sheet is about 0.35–0.95 $g/m^2$ (on one side) and the annealed steel sheet has a surface thin film which is characterized in that the ratio of $I_1/I_0$ is about 0.2–1.5, where $I_1$ is the peak intensity of X-ray diffraction due to (202) plane of $FeCr_2O_4$ or $(Fe,Mn)Cr_2O_4$ and $I_0$ is the peak intensity of X-ray diffraction due to (130) plane of fayalite oxide.

In the above-mentioned process, the decarburization annealing may be accomplished in such a way that the degree of oxidation in the atmosphere at the time of soaking is about 0.30–0.50 expressed as $P(H_2O)/P(H_2)$, and the degree of oxidation in the atmosphere exceeds by about 0.05–0.20 the atmosphere in the heating zone.

In the above-mentioned process, the annealing separator may contain about 0.5–15 pbw (in total) of one kind or more than one kind selected from $SnO_2$, $Fe_2O_3$, $Fe_3O_4$, $MoO_3$, and $WO_3$ and 1.0–15 pbw of $TiO_2$ in 100 pbw of magnesia.

Another feature of the present invention resides in the creation of a grain-oriented silicon steel sheet containing Cr and Bi as steel constituents and having a forsterite coating on the sheet surface, characterized in that the base iron and forsterite coating combined together contain about $C \leqq 30$ wtppm, Si: 2.0–4.5 wt %, Al: 0.005–0.03 wt %, N: 0.0015–0.006 wt %, Mn: 0.02–0.5 wt %, Cr: 0.1–1.0 wt %, and Bi: 0.001–0.15 wt %.

A steel containing both Bi and Cr is found in Example 4 of Japanese Patent Laid-open No. 87316/1991. However, this Japanese patent merely discloses a steel containing only 0.009 wt % of Cr and mentions nothing about the properties of any coating. A steel containing 0.12 wt % of Cr and 0.083wt % or 0.0353 wt % of Bi is found in Example 3 of Japanese Patent Laid-open No. 269571/1996. The techniques in this Japanese patent is not intended to form a forsterite coating in view of the fact that the annealing separator, composed mainly of $Al_2O_3$, is applied afterward. Moreover, Japanese Patent Laid-open No. 269572/1996 discloses an experiment with a steel incorporated with 0.12 wt % of Cr and 0.007 wt % of Bi. The techniques in this Japanese patent relate to annealing for secondary recrystallization in the presence of a temperature gradient; the reference mentions nothing about the properties of coating film. In addition, Japanese Patent Laid-open No. 279247/1997 discloses an experiment with a steel incorporated with 0.12 wt % of Cr and 0.007 wt % of Bi. It gives only one example in which a steel incorporated with Cr is used and it mentions nothing about the effect of Cr on the properties of any coating film. In fact, it relates to a technology for the electrostatic spraying of an annealing separator that follows the application (followed by drying) of an aqueous slurry composed mainly of MgO. These disclosed techniques neither define the object (if any) of adding Cr nor even investigate any relationship between the properties of the coating and the addition of the Cr.

DESCRIPTION OF THE PREFERRED EMBODIMENTS

Figure 1:
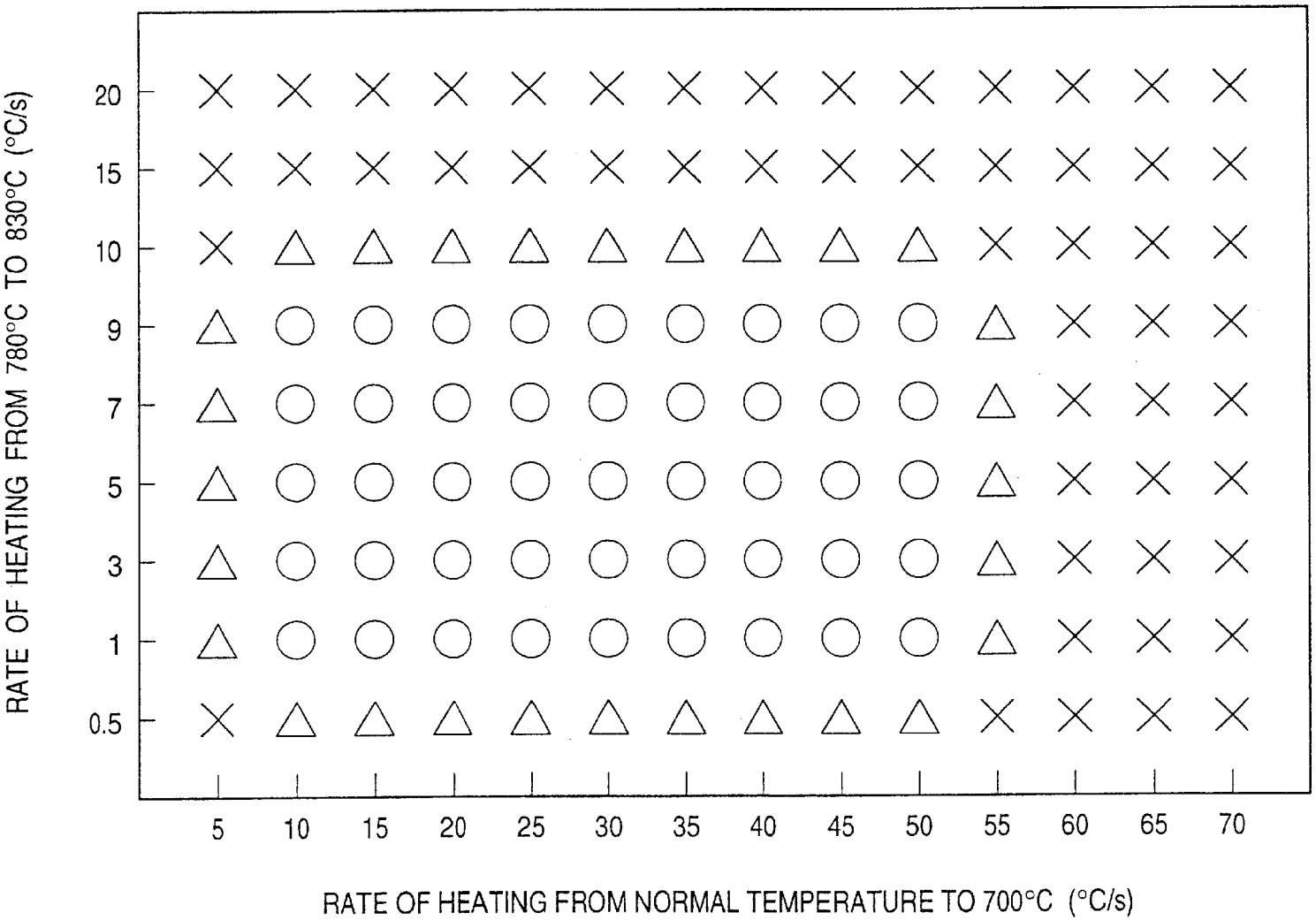
FIG. 1 is a diagram showing how the finished steel sheet varies in coating characteristics and magnetic properties depending on the rate of heating from normal temperature to 700° C. and from 780° C. to 830° C. in decarburization annealing. "X" means apparent defects, "Δ" means some defects, and "○ means "good."

The present inventors carried out a series of researches for producing grain-oriented silicon steel sheets which are superior in magnetic properties and have defect-free uniform forsterite coating with good adhesion over the entire width and length of a product coil even when the steel contains 0.005–0.20 wt % of Bi, with emphasis placed on the properties of the subscale and the conditions of the decarburization annealing. As the result, it was found that a very important factor in achieving good coating is to perform decarburization annealing in such a way that the resulting subscale oxide film contains a Cr oxide of the spinel type, especially a Cr oxide composed mainly of $FeCr_2O_4$ or $(Fe,Mn)Cr_2O_4$ ($0.6 \leqq x \leqq 1$) or mixtures thereof.

In addition, it was found that the properties of the coating are greatly affected by the rate of heating in decarburization annealing. Detailed researches on the rate of heating in decarburization annealing revealed that it is very important to control the rate of heating in two distinct temperature zones, one from normal temperature to 700° C. and the other from the (soaking temperature −50° C.) to the soaking temperature. The rate of heating in the latter temperature zone was found to greatly affect the properties of coating.

The present invention will now be further described with reference to the experimental results of numerous specific tests that we have conducted, as explained below. The test results are not intended to define or to limit the scope of the invention, which is defined by the appended claims.

Experiment 1

Nine crude steel slabs were prepared, each having the composition as shown in Table 1.

TABLE 1

| | Composition (wt %) | | | | | | | | | |
|---|---|---|---|---|---|---|---|---|---|---|
| Co | C | Si | Mn | Se | Acid-soluble Al | N | Sb | Mo | Cr | Bi |
| J | 0.073 | 3.42 | 0.071 | 0.020 | 0.025 | 0.0083 | 0.043 | 0.011 | <0.02 | 0.037 |
| K | 0.071 | 3.41 | 0.073 | 0.018 | 0.027 | 0.0092 | 0.041 | 0.012 | 0.06 | 0.034 |
| L | 0.065 | 3.39 | 0.068 | 0.019 | 0.024 | 0.0086 | 0.040 | 0.011 | 0.10 | 0.038 |
| M | 0.072 | 3.37 | 0.070 | 0.017 | 0.025 | 0.0084 | 0.044 | 0.013 | 0.26 | 0.040 |
| N | 0.068 | 3.38 | 0.066 | 0.019 | 0.022 | 0.0080 | 0.042 | 0.013 | 0.48 | 0.036 |
| O | 0.069 | 3.44 | 0.072 | 0.017 | 0.026 | 0.0087 | 0.045 | 0.011 | 0.74 | 0.043 |
| P | 0.070 | 3.43 | 0.074 | 0.018 | 0.025 | 0.0083 | 0.043 | 0.012 | 1.00 | 0.039 |
| Q | 0.067 | 3.40 | 0.067 | 0.018 | 0.024 | 0.0085 | 0.043 | 0.012 | 1.52 | 0.035 |
| R | 0.066 | 3.41 | 0.073 | 0.019 | 0.026 | 0.0088 | 0.042 | 0.013 | 2.51 | 0.038 |

Each slab was heated at 1420° C. for 20 minutes and then hot-rolled to give a 2.5-mm thick sheet. The hot-rolled sheet underwent annealing at 1000° C. for 1 minute. The annealed sheet underwent cold rolling to give a 1.6-mm thick sheet. The cold-rolled sheet underwent intermediate annealing at 1050° C. for 1 minute. The annealed sheet underwent cold rolling again to give a 0.23-mm thick sheet finally. The second cold rolling was repeated at least twice in such a way that the sheet temperature was 200° C. at the exit of the rolls. With its surface degreased and cleaned, the final cold-rolled sheet underwent decarburization annealing in an atmosphere of $H_2$—$H_2O$—$N_2$ at a soaking temperature of 830° C. in such a way that the amount of oxygen was 0.25–1.10 g/m$^2$ (on one side). The temperature for decarburization annealing was raised at a rate of 5–70° C./s from room temperature to $T_1$° C. (where $T_1$ is 600, 650, 700, 740, 780, and 820) and at a rate of 0.5–20° C./s from $T_1$° C. to 830° C. During decarburization annealing, the degree of oxidation of atmosphere in the soaking zone was kept in the range of 0.30–0.50 and the degree of oxidation of atmosphere in the heating zone was adjusted such that the difference between that in the soaking zone and that in the heating zone is 0.05–0.20; in each case the degree of oxidation of the applicable atmosphere is represented by the ratio of $P(H_2O)/P(H_2)$.

The coiled sheet, which had undergone decarburization annealing, was coated with an annealing separator (in the form of slurry) composed mainly of MgO. After drying, the sheet underwent final finishing annealing. The annealing separator was composed of 100 pbw of magnesia, 8 pbw of $TiO_2$, and 1 pbw of Sr compound (as Sr). The final finishing annealing consisted of three steps. First, the coated sheet was heated to 800° C. in an atmosphere of nitrogen. Then, it was heated to 1150° C. at a rate of 15° C./h in an atmosphere composed of 25% nitrogen and 75% hydrogen (for secondary recrystallization annealing). Finally, it was heated at 1200° C. for 5 hours in an atmosphere of hydrogen (for purifying annealing).

The thus obtained coil was examined for magnetic properties and the forsterite coating formed thereon was also examined for appearance and bending adhesion. As the result, it was found that a steel sheet with good magnetic properties and coating properties can be obtained when the following conditions are satisfied:

The steel initially contains Cr in an amount of 0.1–1.0 wt % (as in the case of steels L, M, N, O, and P).

The temperature in decarburization annealing is raised at a rate of 10–50° C./s from normal temperature to 700° C., and at a rate of 1–9° C./s from a temperature in the range of 700–780° C. to 830° C.

The amount of oxygen is 0.35–0.95 g/m$^2$ in the surface layer of the steel sheet which has undergone decarburization annealing.

Those steel samples designated as J and K, in which the content of Cr was less than 0.10 wt % were unacceptable because of poor coating. Those samples designated as Q and R, in which the content of Cr was more than 1.0 wt % were unacceptable because of poor coating, inadequate decarburization and poor magnetic property.

Those steel sheets containing Cr in an amount of 0.1–1.0 wt % (designated as L, M, N, O, and P) underwent decarburization annealing in such a way that the amount of oxygen was 0.35–0.95 g/m$^2$ in the surface layer of the annealed steel sheet. In this annealing, temperature was raised at varied rates from normal temperature to 700° C. and from 780° C. to 830° C., so as to investigate the effect of the heating rate on the magnetic properties and coating properties of the finished steel sheet. The results are shown in FIG. 1. Evaluations in terms of coating properties and magnetic properties were made according to the following criteria.

○: Coating film with good appearance and good bending adhesion (lower than 25 mm), and magnetic properties with $B_8 \geqq 1.96$ (T) and $W_{17/50} \leqq 0.80$ (W/kg)

Δ: Coating film with some spots through which the iron underneath was exposed, whitish appearance, and bending adhesion lower than 35 mm, and magnetic properties with $1.96 > B_8 \geqq 1.92$ (T) and $0.80 < W_{17/50} \leqq 0.90$ (W/kg).

X: Coating film with many defects and bending adhesion higher than 40 mm, and magnetic properties with $B_8 < 1.92$ (T) and $W_{17/50} > 0.90$ (W/kg).

As shown in FIG. 1, good coating properties and good magnetic properties were obtained together only in the cases designated "○," where the rate of heating from normal temperature to 700° C. was 10–50° C./s and also the rate of heating was from 780° C. to 830° C. rate is 1–9° C./s.

The properties of subscale were examined in greater detail. As the result, it was found that good coating properties and magnetic properties of the product were obtained when a Cr oxide of the spinel type (composed mainly of $FeCr_2O_4$ or $(Fe,Mn)Cr_2O_4$) was formed in subscale. This Cr oxide of the spinel type is a new substance which is entirely different from the known fayalite oxide (composed mainly of $Fe_2SiO_4$ or $(Fe,Mn)_2SiO_4$) and silica.

Figure 2:
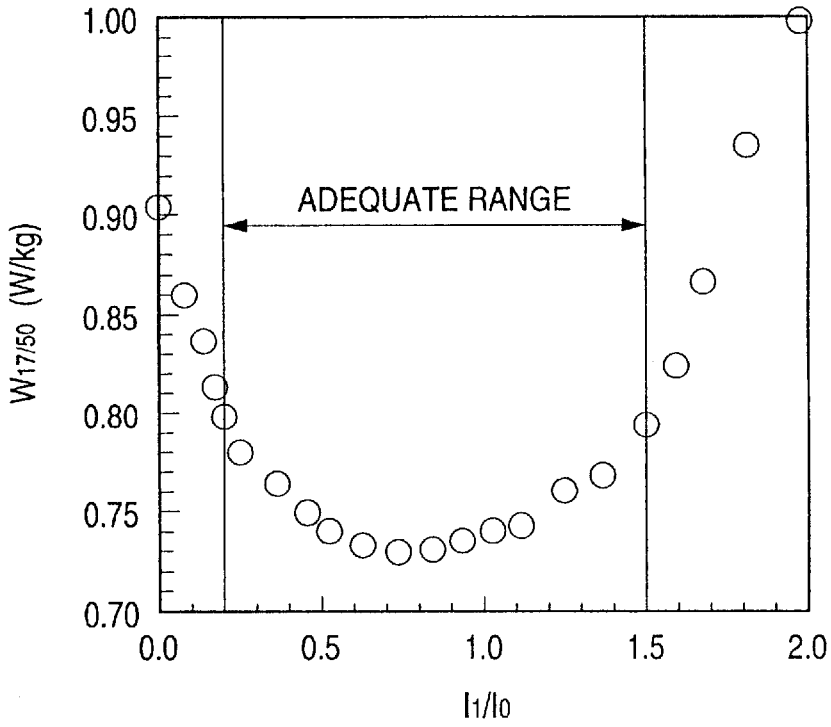
FIGS. 2(*a*) and 2(*b*) are diagrams showing how the finished steel sheet varies in (*a*) coating characteristics and (*b*) magnetic properties depending on the ratio $I_1/I_0$, where $I_1$ is the peak intensity of X-ray diffraction due to (202) plane of $FeCr_2O_4$ or $(Fe,Mn)Cr_2O_4$ ($0.6 \leqq x \leqq 11$) and $I_0$ is the peak intensity of X-ray diffraction due to (130) plane of fayalite oxide, in the thin film on the surface of a steel sheet which has undergone decarburization annealing.
Figure 2:
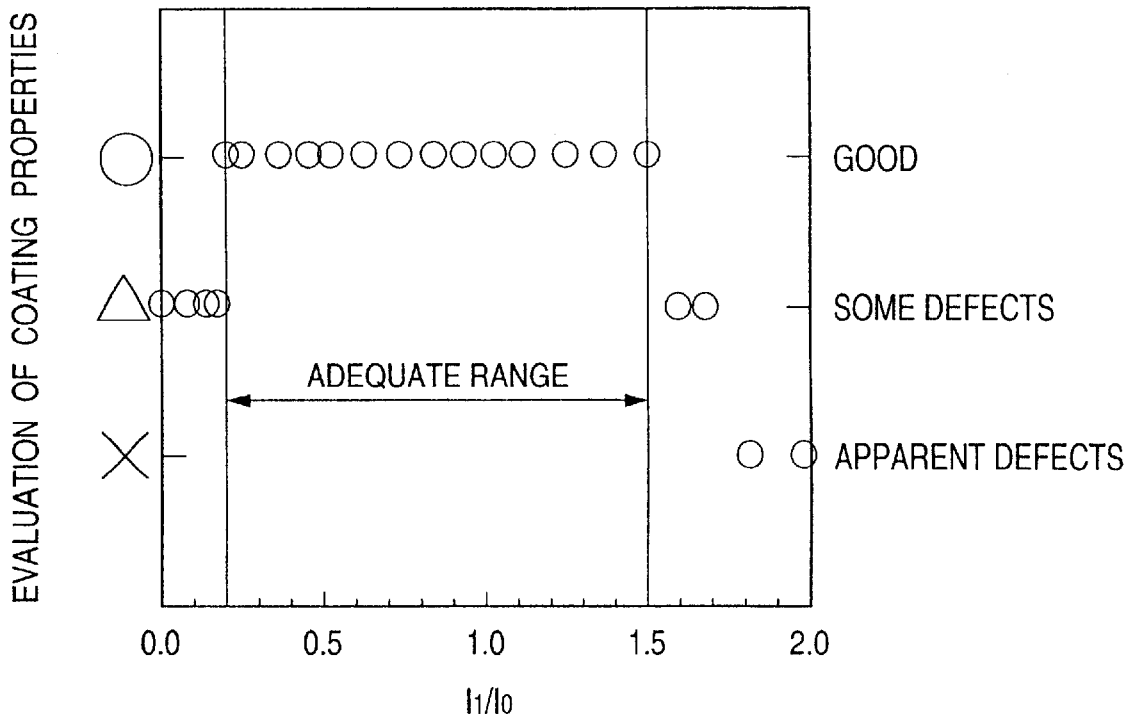

The steel sheet which had undergone decarburization annealing was examined for its surface quality by thin-film X-ray diffraction. The peak intensity $I_1$ due to the (202) plane of $FeCr_2O_4$ or $Fe_xMn_{1-x}Cr_2O_4$ $(0.6 \leqq x \leqq 1)$ was measured, and the peak intensity $I_0$ due to the (130) plane of fayalite oxide was measured. An investigation was made of the relation between the ratio of intensity $(I_1/I_0)$ and the magnetic properties and coating properties of the finished steel sheet. The results are shown in FIGS. 2(*a*) and 2(*b*). It is noted that good coating properties and magnetic properties are obtained when the ratio $I_1/I_0$ is 0.2–1.5. In the case of $I_1/I_0 < 0.2$, the properties are slightly inferior for the probable reasons that either fayalite oxide was formed excessively, or that Cr oxide of the spinel type was insufficiently formed. On the other hand, in the case of $I_1/I_0 > 1.5$, the properties were inferior for the probable reason that either fayalite oxide was insufficiently formed or that Cr oxide of the corundum type was formed excessively.

Figure 3:
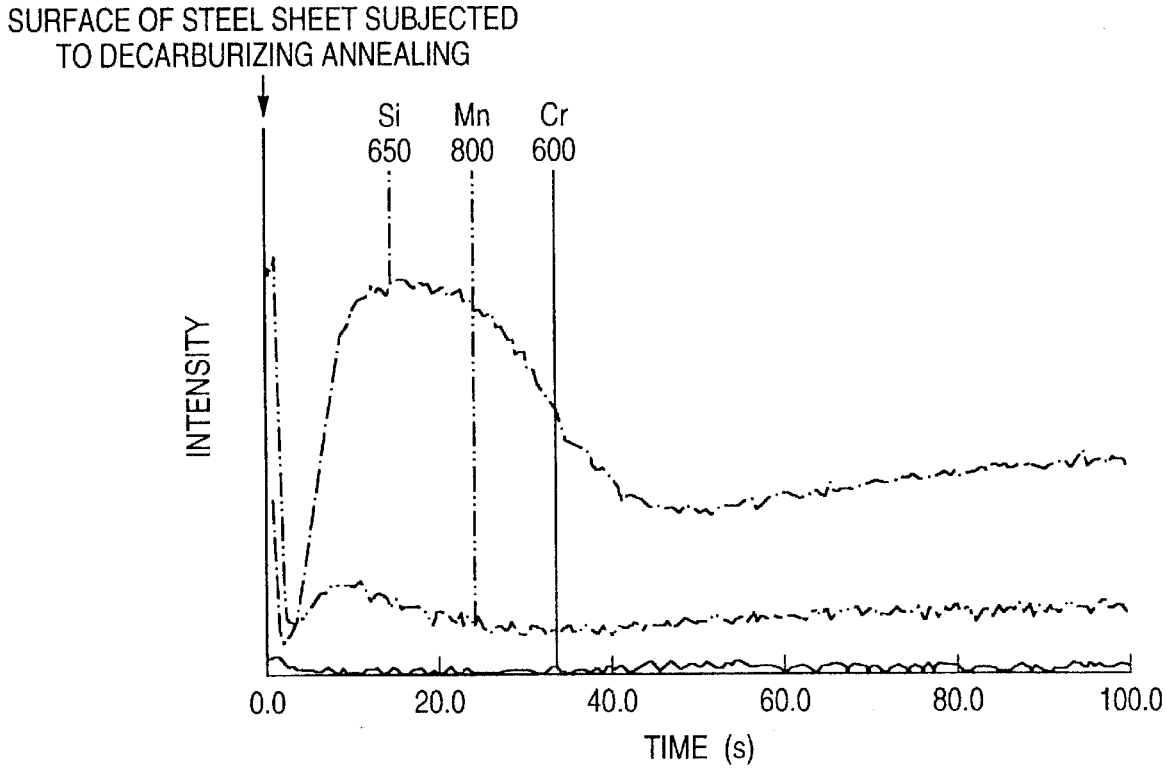
FIGS. 3(*a*) and 3(*b*) are diagrams showing the results of glow discharge spectrometry (GDS) performed on the subscale of a steel sheet which has undergone decarburization annealing. The diagram FIG. 3(*a*) represents a sample of subscale in which a Cr compound of the spinel type is not formed. The diagram FIG. 3(*b*) represents a sample of subscale in which a Cr compound of the spinel type is formed.
Figure 3:
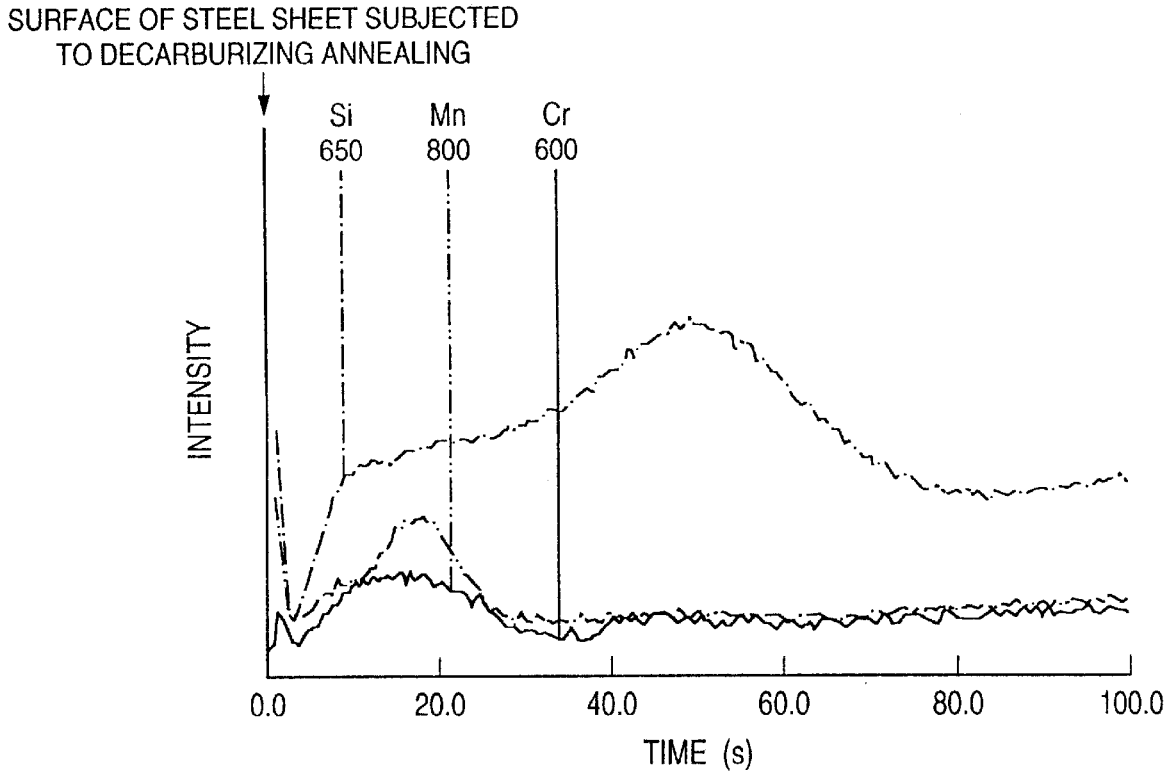

The steel sheets which had undergone decarburization annealing were divided into two groups according to whether or not the Cr compound of the spinel type was formed in the subscale. The sheets were subjected to surface analysis by glow discharge spectrometry (GDS). The results are shown in FIGS. 3(*a*) and 3(*b*). It is noted from FIGS. 3(*a*) and 3(*b*) that those samples of FIG. 3(*a*) with a Cr compound of the spinel type all contain Cr that is concentrated immediately under the surface layer. It is also noted that they have an Si profile which is different from that in samples represented in FIG. 3(*b*) that are without a Cr compound of spinel type. It is considered that not only a Cr compound of spinel type but also the change in Si profile contributes to improvement of film properties.

According to the present invention, good coating properties and good magnetic properties are obtained if the subscale contains $FeCr_2O_4$ or $Fe_xMn_{1-x}Cr_2O_4$(x (0.6≦x1) in an adequate amount. This may be reasoned as follows.

During finishing annealing, $FeCr_2O_4$ reacts with MgO according to the following formula:

$$FeCr_2O_4 + MgO \rightarrow (Mg_xFe_{1-x})O + Fe_xMg_{1-x}Cr_2O_4$$

The $(Mg_xFe_{1-x})O$ formed in this reaction promotes the formation of forsterite by solid-phase reaction between MgO and $SiO_2$. What is important is that the $(Mg_xFe_{1-x})O$ is formed not on the surface of the steel sheet but slightly under the surface of the steel sheet. In other words, forsterite is formed favorably at this position and hence the resulting coating film hardly peels off, with improved adhesion.

The Cr compound of the spinel type in the subscale does not remain in the fosterite on the surface of the final product. It is absorbed in the non-reacting annealing separator as the reduced products or solid solution during the secondary recrystalization annealing or purification annealing. The non-reacting annealing separator is washed away after the purification annealing. The formation of coating film is promoted in the initial stage of finishing annealing; therefore, the nitrification and denitrification reactions during finishing annealing are rather stable. Such stable reactions are desirable for secondary recrystallization and hence contribute to the improved and stabilized magnetic properties.

According to the present invention, decarburization annealing is carried out in such a way that the rate of heating from normal temperature to 700° C. is about 10–50° C./s and the rate of heating from (soaking temperature −50° C.) to soaking temperature is about 1–9° C./s. In addition, decarburization annealing is carried out under the condition that the degree of oxidation by the atmosphere at the time of soaking is about 0.30–0.50 and the difference in the degree of oxidation by the atmosphere between the soaking zone and the heating zone is about 0.05–0.20. In this way it is possible to control the composition of the coating film. This may be reasoned as follows.

The steel sheets which had undergone decarburization annealing were pickled in 5% HCl at 60° C. for 60 seconds, and weight loss on pickling was measured. It was found that weight loss on pickling greatly varies depending on the condition of decarburization annealing and that magnetic properties as well as coating properties are improved according as weight loss on pickling decreases. Weight loss on pickling is affected by the properties of the outermost surface of subscale, and hence it is somewhat affected by the initial stage of reaction to form the coating film.

Then, an investigation was made on the relationship between weight loss on pickling and the condition of decarburization annealing. As the result, it was found that weight loss on pickling decreases remarkably if the heating rate and the degree of atmospheric oxidation are controlled as mentioned above, than if they are not controlled.

The decrease in weight loss on pickling is due to the presence of dense oxide film which is formed in the initial stage of oxidation if the rate of heating from (soaking temperature −50° C.) to soaking temperature is decreased and the degree of oxidation by the atmosphere is adjusted within a prescribed range. Therefore, the rate of heating and the degree of oxidation by the atmosphere greatly influence the properties of subscale to be formed afterward.

Cr promotes oxidation at the time of decarburization annealing; therefore, an excess amount of Cr added results in uneven oxidation, giving rise to defective coating film. However, Cr also causes oxidation to proceed comparatively uniformly if the rate of heating from (soaking temperature −50° C.) to soaking temperature is reduced to about 1–9° C./s. (The starting temperature corresponds to the initial stage of oxidation.)

The Cr added increases the resistivity of the steel sheet, and hence a larger amount of Cr added favors a decrease in eddy current loss. On the other hand, the Cr added decreases the saturation magnetic flux density. Therefore, it cannot be said unconditionally that a large amount of Cr added decreases iron loss. The upper limit of the amount of Cr added used to be about 0.3 wt %, because Cr greatly hampers decarburization annealing or degrades the magnetic properties and coating properties due to incomplete secondary recrystallization in the case where AlN is used as an inhibitor.

By contrast, the present invention permits satisfactory secondary recrystallization and provides good forsterite coating even in the case where the amount of Cr is as much as about 0.4–1.0 wt %. As a result, it has become possible to consistently obtain products with a very low iron loss. It was also found that a large amount of Cr added does not pose any problem with decarburization annealing if the raw material contains Bi, because Bi promotes decarburization annealing. This finding is another basis for the present invention.

The process of the present invention is applied to a specific steel whose composition is limited as follows:

C: about 0.030–0.12 wt %

C is an important component which improves the crystal structure through the α-γ transformation at the time of hot rolling. With a C content less than 0.030 wt %, any steel is poor in primary recrystallization structure. With a C content more than 0.12 wt %, any steel presents difficulties in decarburization and hence tends to become poor in magnetic properties due to inadequate decarburization. Therefore, the content of C is limited to 0.030–0.12 wt %.

Si: about 2.0–4.5 wt [{]ps

Si is an important component which increases electrical resistance and decreases eddy current loss. With an Si content less than 2.0 wt %, any steel has its grain orientation impaired by α-γ transformation during final finishing annealing. With an Si content more than 4.5 wt %, any steel is poor in cold-rollability. Therefore, the content of Si is limited to 2.0–4.5 wt %.

Acid-soluble Al: about 0.01–0.05 wt % and N: about 0.003–0.012 wt %

Acid-soluble Al and N are elements necessary to form the AlN inihibitor. For good secondary recrystallization, it is essential that the content of acid-soluble Al should be 0.01–0.05 wt % and the content of N should be 0.003–0.012 wt %. If present in excess of their upper limits, they give rise to coarse AlN which does not function properly as an inhibitor. If their content is less than their lower limits, they do not form AlN sufficiently.

Mn: about 0.02–0.5 wt %

Mn is an important element which, like Si, increases electrical resistance and improves hot-rollability. The content of Mn necessary for this purpose is 0.02 wt % and above. However, if present in excess of 0.5 wt %, Mn brings about γ transformation which deteriorates magnetic properties. Therefore, the content of Mn is limited to 0.02–0.5 wt %.

Cr: about 0.1–1.0 wt %

Cr plays a critically important role in the present invention. When adequately incorporated into a steel, Cr forms a Cr spinel compound in the oxide film (subscale) which occurs during decarburization annealing. With a content less than 0.1 wt %, Cr does not form any Cr compound of spinel type. With a content more than 1.0 wt %, Cr makes decarburization difficult, deteriorating magnetic properties due to inadequate decarburization. Therefore, the content of Cr is limited to about 0.1–1.0 wt %.

Bi: about 0.005–0.20 wt %

Bi is an essential element which greatly improves magnetic properties and hence effectively contributes to a steel with a high magnetic flux density. With a content less than about 0.005 wt %, Bi does not fully produce the effect of increasing magnetic flux density. With a content more than about 0.20 wt %, Bi hampers primary recrystallization, resulting in low magnetic flux density. Therefore, the content of Bi is limited to about 0.005–0.20 wt %.

Moreover, if necessary, the present invention permits the steel to contain S and/or Se as an element to form the inhibitor. Besides, the steel may contain one member or more than one member selected from Sb, Cu, Sn, Ge, Ni, P, Nb, and V. In addition, the steel may contain Mo in an adequate amount as a component to improve the surface properties.

Their adequate contents are as follows:

Se and/or S: about 0.010–0.040 wt %

Se and S combine with Mn to form MnSe and MnS, respectively, which function as an inhibitor. Regardless of whether they are used alone or in combination with each other, they do not provide sufficient inhibitor if their content is less than about 0.010 wt %. On the other hand, they excessively raise the slab heating temperature necessary for the inhibitor component to form a solid solution if their content is more than about 0.040 wt %. Therefore, the content of Se and S (used alone or in combination) is limited to about 0.010–0.040 wt %.

Sb: about 0.005–0.20 wt %

Sb does not produce the effect of improving magnetic flux density if its content is less than about 0.005 wt %. On other hand, Sb has an adverse effect on decarburization if its content exceeds about 0.20 wt %. Therefore, the content of Sb is limited to about 0.005–0.20 wt %.

Cu: about 0.01–0.20 wt %

Cu does not produce the effect of improving magnetic flux density if its content is less than about 0.01 wt %. On the other hand, Cu has an adverse effect on pickling if its content exceeds about 0.20 wt %. Therefore, the content of Cu is limited to about 0.01–0.20 wt %.

Sn: about 0.02–0.30 wt %; Ge: about 0.02–0.30 wt %

Sn and Ge do not produce the effect of improving magnetic flux density if their content is less than about 0.02 wt % each. On the other hand, they merely give a poor structure due to primary recrystallization, which leads to poor magnetic properties, if their content exceeds about 0.30 wt % each. Therefore, the content of Sn and Ge is limited to about 0.02–0.30 wt % each.

Ni: about 0.01–0.50 wt %

Ni does not produce the effect of improving magnetic flux density if its content is less than about 0.01 wt %. On the other hand, Ni has an adverse effect on hot strength if its content exceeds about 0.50 wt %. Therefore, the content of Ni is limited to about 0.01–0.50 wt %.

P: about 0.002–0.30 wt %

P does not produce the effect of improving magnetic flux density if its content is less than about 0.002 wt %. On the other hand, it merely gives a poor structure due to primary recrystallization, which leads to poor magnetic properties, if its content exceeds 0.30 wt %. Therefore, the content of P is limited to about 0.002–0.30 wt %.

Nb: about 0.003–0.10 wt %; V: about 0.003–0.10 wt %

Nb and V do not produce the effect of improving magnetic flux density if their content is less than about 0.003 wt % each. On the other hand, they have an adverse effect on decarburization if their content exceeds about 0.10 wt % each. Therefore, the content of Nb and V is limited to about 0.003–0.10 wt % each.

Mo: about 0.005–0.10 wt %

Mo is an element which effectively improves the surface properties. Mo does not produce the desired effect if its content is less than about 0.005 wt %. On the other hand, Mo has an adverse effect on decarburization if its content exceeds about 0.10 wt %. Therefore, the content of Mo is limited to about 0.005–0.10 wt %.

According to the present invention, the silicon steel sheet is produced under the desirable condition as mentioned below.

A molten steel of the above-mentioned composition is prepared in the usual way, and it is made into slabs by continuous casting process or ingot making process, along with optional blooming. The slab, heated to about 1100–1450° C., undergoes hot rolling, followed by optional annealing. The hot-rolled sheet undergoes cold rolling once or twice or more, with intermediate annealing performed after each cold rolling, so that the cold-rolled sheet has a final thickness as desired. Incidentally, at least one pass of the final cold rolling should be carried out such that the steel sheet has a temperature of about 150–300° C. immediately after it has left the rolls. This practice is useful for improvement in magnetic properties. The cold-rolled steel sheet undergoes decarburization annealing. This step is most important in the present invention. This decarburization annealing forms a Cr spinel oxide in the subscale. The amount of subscale should preferably be about 0.35–0.95 $g/m^2$ (expressed as oxygen) in the surface layer of steel sheet (on one side).

The Cr spinel oxide should be formed in such an amount that the ratio of $I_1/I_0$ is about 0.2–1.5, where $I_1$ is the peak intensity of X-ray diffraction due to (202) plane of $FeCr_2O_4$ or $Fe_xMn_{1-x}Cr_2O_4$ ($0.6 \leqq x \leqq 1$) and $I_0$ is the peak intensity of X-ray diffraction due to (130) plane of fayalite oxide.

The subscale containing a Cr oxide of spinel type in an adequate amount can be formed if decarburization annealing is carried out under the following conditions: Soaking temperature: about 800–900° C.; the average rate of heating from room temperature to 700° C: about 10–50° C./s; the average rate of heating from (soaking temperature −50° C.) to soaking temperature: about 1–9° C./s; the degree of oxidation by the atmosphere during soaking: about 0.30–0.50 in terms of $P(H_2O)/P(H_2)$; the difference in the degree of oxidation between the soaking zone and the heating zone: about 0.05–0.20.

The decarburation annealed sheet of course has the same formulation as the slab, but the carbon content is the same as the final sheet, having been reduced to that value in decarburation annealing. The amounts of Al, N and Bi correspond to the amounts in the slab; they are not decreased until subsequent purification annealing takes place.

After decarburization annealing, the steel sheet may be slightly nitrided (about 30–200 ppm).

The surface of the steel sheet which has undergone decarburization annealing is coated with an annealing separator (in the form of slurry) composed mainly of MgO. This step is followed by drying. MgO constituting the annealing separator should preferably be a hydrous one which contains about 1–5% of water. (This water content is determined by ignition at 1000° C. for 1 hour after hydration at 20° C. for 6 minutes.) With a water content less than about 1%, MgO does not form forsterite coating satisfactorily. On the other hand, with a water content more than about 5%, MgO does not form good forsterite coating; excess water oxidizes the steel sheet excessively.

In addition, the MgO should have a citric acid activity (CAA 40) of about 30–160 seconds at 30° C. With a CAA less than about 30 seconds, MgO is so reactive that it forms forsterite coating rapidly. (The resulting forsterite coating peels off easily.) On the other hand, with a CAA more than about 180 seconds, MgO is so inactive as to form a forsterite coating poorly.

Moreover, the MgO should preferably have a BET specific surface area of about 10–40 $m^2/g$. With a value smaller than about 10 $m^2/g$, MgO is too inactive to form forsterite coating. On the other hand, with a value larger than about 40 $m^2/g$, MgO is so reactive that it forms forsterite coating rapidly and the resulting forsterite coating peels off too easily.

The annealing separator should preferably be applied in an amount of about 4–10 $g/m^2$ (on one side of the steel sheet). With a coating weight less than about 4 $g/m^2$, the annealing separator does not form forsterite coating sufficiently. On the other hand, with a coating weight more than about 10 $g/m^2$, the annealing separator forms forsterite coating excessively, which leads to a decrease in space factor.

The annealing separator may be one which is composed of about 100 pbw of magnesia, about 0.5–15 pbw in total of at least one member selected from $SnO_2$, $Fe_2O_3$, $Fe_3O_4$, $MoO_3$, and $WO_3$, and about 1.0–15 pbw of $TiO_2$. This annealing separator gives rise to forsterite coating of better quality. This has been supported by the results of the following fundamental experiment, which was carried out to find out any compound which promotes the formation of forsterite at low temperatures (about 850–950° C).

Experiment 2

Figure 4:
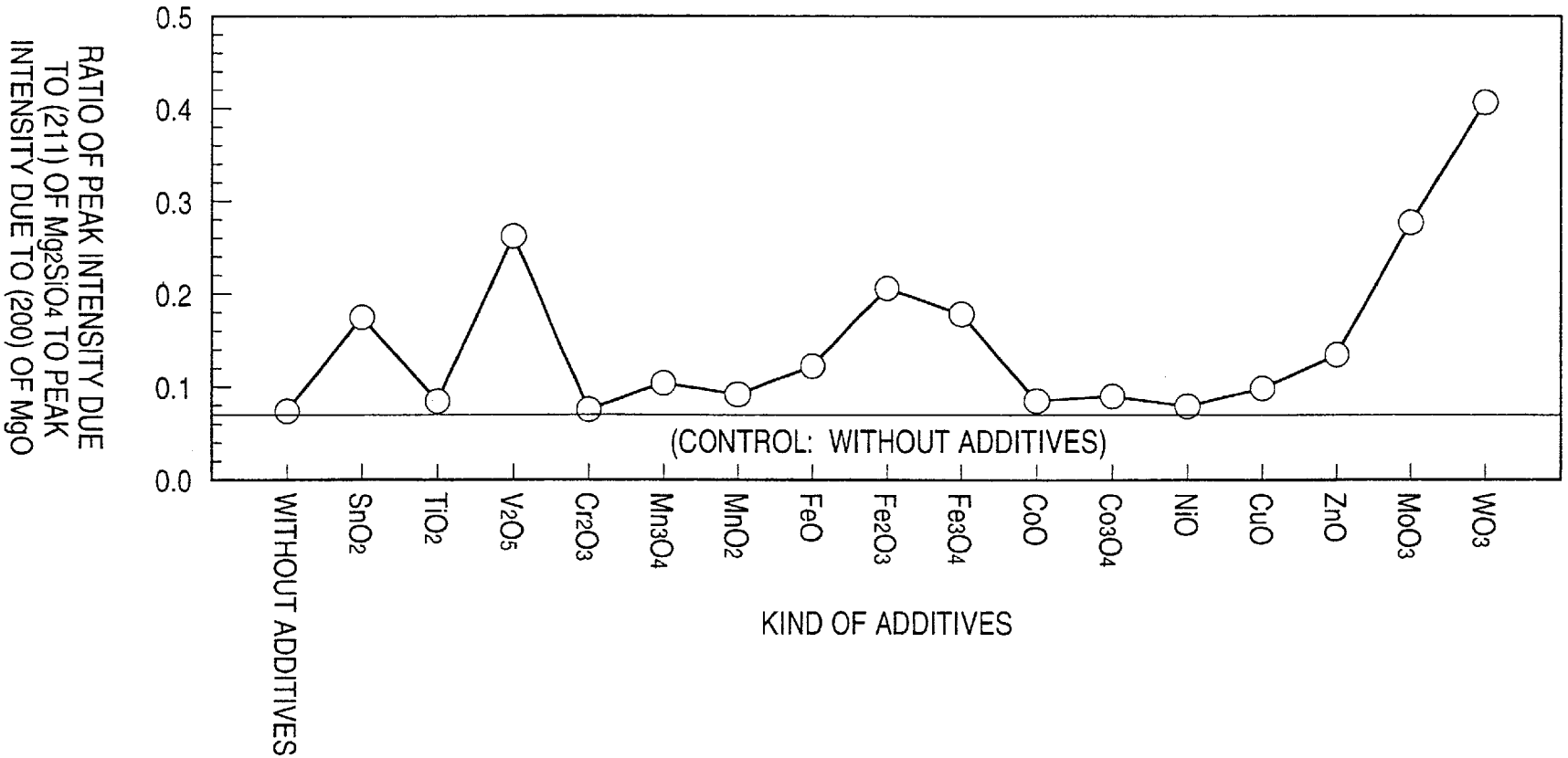
FIG. 4 is a diagram showing the effect of various compounds on the formation of forsterite.

MgO powder and $SiO_2$ powder were mixed in a molar ratio of 2:1. The resulting mixture was incorporated with 10 pbw of one of any of the compounds shown in Table 2 for 100 pbw of MgO. The resulting mixture was molded and fired in a hydrogen atmosphere at 950° C. for 1 hour. The fired sample was crushed and analyzed by X-ray diffraction to obtain the peak intensity ($I_1$) due to (211) plane of $Mg_2SiO_4$ and the peak intensity ($I_2$) due to (200) plane of MgO. The same experiment as above was carried out except that the additive was not used. The ratio of $I_1/I_2$ was compared with that of the control to see if the additive promotes the formation of forsterite. The results are shown in FIG. 4. It is noted from FIG. 4 that $SnO_2$, $V_2O_5$, $Fe_2O_3$, $Fe_3O_4$, $MoO_3$, and $WO_3$ promote the formation of forsterite during firing at 950° C.

TABLE 2

| Sample | 1 | 2 | 3 | 4 | 5 | 6 | 7 | 8 | 9 |
|---|---|---|---|---|---|---|---|---|---|
| Additive | none | $SnO_2$ | $TiO_2$ | $V_2O_5$ | $Cr_2O$ | $Mn_3O$ | $MnO_2$ | FeO | $Fe_2O$ |
| Sample | 10 | 11 | 12 | 13 | 14 | 15 | 16 | 17 | |
| Additive | $Fe_3O$ | CoO | $Co_3O$ | NiO | CuO | ZnO | $MoO_3$ | $WO_3$ | |

Experiment 3

The results of Experiment 2 suggest that if the annealing separator is incorporated with any of $SnO_2$, $V_2O_5$, $Fe_2O_3$, $Fe_3O_4$, $MoO_3$, and $WO_3$, then forsterite coating of very good quality would be formed in the case of steel containing Bi. This was supported by the following experiment.

A slab was prepared from a steel containing C: 0.067 wt %, Si: 3.25 wt %, Mn: 0.072 wt %, Se: 0.018 wt %, acid-soluble Al: 0.024 wt %, N: 0.0090 wt %, Sb: 0.025 wt %, Mo: 0.012 wt %, and Bi 0.020 wt %. The slab was heated at 1410° C. for 30 minutes and then hot-rolled into a 2.2-mm thick sheet. The hot-rolled sheet was annealed at 1000° C. for 1 minute. The annealed sheet was cold-rolled into a 1.6-mm thick sheet. The cold-rolled sheet underwent intermediate annealing at 1000° C. for 1 minute. The annealed sheet was cold-rolled again into a 0.23-mm thick sheet (final thickness). The cold-rolled sheet was degreased to clean its surface. The cleaned sheet underwent decarburization annealing in an atmosphere of $H_2$—$H_2O$—$N_2$ at a soaking temperature of 820° C. such that the amount of oxygen is 0.4–0.8 g/m$^2$ on one side. This decarburization annealing was carried out in such a way that the rate of heating up to 750° C. was 20° C./s and the rate of heating from 750° C. to 820° C. was 5° C./s and the degrees of oxidation (in terms of $P(H_2O)/P(H_2)$) was 0.40 in the atmosphere of the soaking zone.

The coiled sheet which had undergone decarburization annealing was coated with an annealing separator (in the form of slurry) which is composed of 100 pbw of MgO, 0.5–20 pbw of $TiO_2$, and 0.2–20 pbw of any one member or more selected from $SnO_2$, $V_2O_5$, $Fe_2O_3$, $Fe_3O_4$, $MoO_3$, and $WO_3$. After drying, the coated sheet was annealed in a nitrogen atmosphere at 850° C. This annealing was followed by annealing for secondary recrystallization in an atmosphere composed of 25% nitrogen and 75% hydrogen, with the temperature raised up to 1150° C. at a rate of 20° C./h. The steel was finally subjected to purification annealing in an atmosphere of hydrogen at 1200° C. for 5 hours.

The thus obtained coiled sheet was examined for the appearance of forsterite coating. The results are shown in Tables 3 and 4. It is noted that the samples had forsterite coating of very good quality if they were given an annealing separator composed of 100 pbw of MgO, 1.0–15 pbw of $TiO_2$, and 0.5–15 pbw of any one member or more selected from $SnO_2$, $Fe_2O_3$, $Fe_3O_4$, and $MoO_3$. Incidentally, it was found that $V_2O_5$, did not improve the characteristics of forsterite coating on the actual coiled sheet although it promoted the formation of forsterite coating in Experiment 2.

Moreover, in order to improve the uniformity of the forsterite coating, the annealing separator may be incorporated additionally with any one member or more selected from oxides (such as CaO), sulfates (such as $MgSO_4$ and $SnSO_4$). B compounds (such as $Na_2B_4O_7$), Sb compounds (such as $Sb_2O_3$ and $Sb_2(SO_4)_3$) , and Sr compounds (such as $SrSO_4$ and $Sr(OH)_2$). They may be used alone or in combination with one another.

TABLE 3

| Run No. | Amount of compound added to the annealing separator (pbw for 100 pbw of magnesia) | | | | | | | Coating appearance |
|---|---|---|---|---|---|---|---|---|
| | $TiO_2$ | $SnO_2$ | $V_2O_5$ | $Fe_2O_3$ | $Fe_3O_4$ | $MoO_2$ | $WO_3$ | |
| 1 | 0.5 | 0 | 0 | 0 | 0 | 20 | 0 | ○ |
| 2 | 1 | 0 | 0 | 0 | 0 | 0 | 0 | ○ |
| 3 | 5 | 0 | 0 | 0 | 0 | 0 | 0 | ○ |
| 4 | 10 | 0 | 0 | 0 | 0 | 0 | 0 | ○ |
| 5 | 15 | 0 | 0 | 0 | 0 | 0 | 0 | ○ |
| 6 | 20 | 0 | 0 | 0 | 0 | 0 | 0 | ○ |
| 7 | 0.8 | 5 | 0 | 0 | 0 | 0 | 0 | ○ |
| 8 | 1 | 5 | 0 | 0 | 0 | 0 | 0 | ◎ |
| 9 | 5 | 5 | 0 | 0 | 0 | 0 | 0 | ◎ |
| 10 | 10 | 5 | 0 | 0 | 0 | 0 | 0 | ◎ |
| 11 | 15 | 5 | 0 | 0 | 0 | 0 | 0 | ◎ |
| 12 | 17 | 5 | 0 | 0 | 0 | 0 | 0 | ○ |
| 13 | 8 | 0.3 | 0 | 0 | 0 | 0 | 0 | ○ |
| 14 | 8 | 0.5 | 0 | 0 | 0 | 0 | 0 | ◎ |
| 15 | 8 | 5 | 0 | 0 | 0 | 0 | 0 | ◎ |
| 16 | 8 | 10 | 0 | 0 | 0 | 0 | 0 | ◎ |
| 17 | 8 | 15 | 0 | 0 | 0 | 0 | 0 | ◎ |
| 18 | 8 | 17 | 0 | 0 | 0 | 0 | 0 | ○ |
| 19 | 10 | 0 | 0.3 | 0 | 0 | 0 | 0 | ○ |
| 20 | 10 | 0 | 1 | 0 | 0 | 0 | 0 | ○ |
| 21 | 10 | 0 | 5 | 0 | 0 | 0 | 0 | ○ |
| 22 | 10 | 0 | 10 | 0 | 0 | 0 | 0 | ○ |
| 23 | 10 | 0 | 15 | 0 | 0 | 0 | 0 | ○ |
| 24 | 6 | 0 | 0 | 0.3 | 0 | 0 | 0 | ○ |
| 25 | 6 | 0 | 0 | 0.5 | 0 | 0 | 0 | ◎ |
| 26 | 6 | 0 | 0 | 4 | 0 | 0 | 0 | ◎ |
| 27 | 6 | 0 | 0 | 9 | 0 | 0 | 0 | ◎ |
| 28 | 6 | 0 | 0 | 15 | 0 | 0 | 0 | ◎ |
| 29 | 6 | 0 | 0 | 18 | 0 | 0 | 0 | ○ |
| 30 | 7 | 0 | 0 | 0 | 0.3 | 0 | 0 | ○ |
| 31 | 7 | 0 | 0 | 0 | 0.5 | 0 | 0 | ◎ |
| 32 | 7 | 0 | 0 | 0 | 2 | 0 | 0 | ◎ |
| 33 | 7 | 0 | 0 | 0 | 5 | 0 | 0 | ◎ |

Criteria for the appearance of forsterite coating film
◎: completely uniform
○: almost uniform
Δ: whitish coating, with the iron underneath not exposed
X: whitish coating, with the iron underneath partly exposed.

TABLE 4

| Run No. | Amount of compound added to the annealing separator (pbw for 100 pbw of magnesia) | | | | | | | Coating appearance |
|---|---|---|---|---|---|---|---|---|
| | $TiO_2$ | $SnO_2$ | $V_2O_5$ | $Fe_2O_3$ | $Fe_3O_4$ | $MoO_2$ | $WO_3$ | |
| 34 | 7 | 0 | 0 | 0 | 0 | 0 | 0 | ◎ |
| 35 | 7 | 0 | 0 | 0 | 15 | 0 | 0 | ◎ |
| 36 | 7 | 0 | 0 | 0 | 16 | 0 | 0 | ○ |
| 37 | 5 | 0 | 0 | 0 | 0 | 0.3 | 0 | ○ |
| 38 | 5 | 0 | 0 | 0 | 0 | 0.5 | 0 | ◎ |
| 39 | 5 | 0 | 0 | 0 | 0 | 4 | 0 | ◎ |
| 40 | 5 | 0 | 0 | 0 | 0 | 10 | 0 | ◎ |
| 41 | 5 | 0 | 0 | 0 | 0 | 15 | 0 | ◎ |
| 42 | 5 | 0 | 0 | 0 | 0 | 20 | 0 | ○ |

TABLE 4-continued

| Run No. | Amount of compound added to the annealing separator (pbw for 100 pbw of magnesia) | | | | | | | Coating appearance |
|---|---|---|---|---|---|---|---|---|
| | $TiO_2$ | $SnO_2$ | $V_2O_5$ | $Fe_2O_3$ | $Fe_3O_4$ | $MoO_2$ | $WO_3$ | |
| 43 | 12 | 0 | 0 | 0 | 0 | 0 | 0.3 | ○ |
| 44 | 12 | 0 | 0 | 0 | 0 | 0 | 0.5 | ⊙ |
| 45 | 12 | 0 | 0 | 0 | 0 | 0 | 4 | ⊙ |
| 46 | 12 | 0 | 0 | 0 | 0 | 0 | 8 | ⊙ |
| 47 | 12 | 0 | 0 | 0 | 0 | 0 | 11 | ⊙ |
| 48 | 12 | 0 | 0 | 0 | 0 | 0 | 15 | ⊙ |
| 49 | 12 | 0 | 0 | 0 | 0 | 0 | 16 | ○ |
| 50 | 1 | 0 | 0 | 0.3 | 0 | 0 | 0 | ⊙ |
| 51 | 0.8 | 0.5 | 0 | 0 | 0 | 0 | 3 | ○ |
| 52 | 5 | 3 | 0 | 0 | 0 | 0 | 0.3 | ⊙ |
| 53 | 3 | 0.3 | 0 | 0 | 0 | 2 | 0 | ⊙ |
| 54 | 8 | 3 | 0 | 0.3 | 0.3 | 0 | 5 | ⊙ |
| 55 | 10 | 0 | 0 | 2 | 0 | 0 | 3 | ⊙ |
| 56 | 18 | 5 | 0 | 5 | 0 | 0.3 | 0 | ○ |
| 57 | 5 | 0 | 0 | 0 | 0.5 | 0 | 0 | ○ |
| 58 | 6 | 20 | 0 | 1.5 | 1.5 | 0 | 3 | ⊙ |
| 59 | 15 | 0 | 0 | 0 | 0.5 | 0 | 0.5 | ⊙ |
| 60 | 9 | 3 | 0 | 1 | 1 | 1 | 1 | ⊙ |
| 61 | 9 | 0 | 0 | 0.4 | 0.4 | 0 | 0 | ⊙ |
| 62 | 0.8 | 5 | 0 | 0 | 0 | 3 | 0 | ○ |
| 63 | 1 | 4 | 0 | 4 | 4 | 1 | 1 | ⊙ |
| 64 | 5 | 0 | 0 | 0 | 3 | 3 | 3 | ⊙ |
| 65 | 5 | 10 | 0 | 0 | 10 | 0 | 10 | ○ |
| 66 | 10 | 2 | 0 | 15 | 0 | 0 | 0 | ○ |

Criteria for the appearance of forsterite coating film
⊙: completely uniform
○: almost uniform
Δ: whitish coating, with the iron underneath not exposed
X: whitish coating, with the iron underneath partly exposed.

Subsequently, the sheet underwent secondary recrystallization and purification annealing (final finishing annealing). It was given an insulating coating of phosphate, preferably the one which has tension. Incidentally, the annealing for secondary recrystallization may be accomplished, if necessary, after keeping at 700–1000° C. for 10–70 hours.

Also, the final cold rolling may be followed by the known step of breaking magnetic domains which is intended to reduce iron loss more. This step may be accomplished after final cold rolling after final finishing annealing or insulting coating.

Thus, it is possible to obtain a grain-oriented silicon steel with very good coating properties. It is to be noted that the process of the present invention provides uniform defect-free forsterite coating with good adhesion even in the case of silicon steel containing Bi as an auxiliary inhibitor. (In the past, it was difficult to form a coating film with good adhesion on such a silicon steel.) Therefore, the steel sheet produced by the process of the present invention has both better magnetic properties and better coating properties than conventional ones.

The Bi-containing steel sheet in the present invention varies in composition in its manufacturing steps, particularly in the decarburization annealing step and the purification annealing step. A desirable composition of the finished steel sheet is as follows.

C≦30 wt ppm, Si: 2.0–4.5 wt %, Al: 0.005–0.03 wt %, N: 0.0015–0.006 wt %, Mn: 0.02–0.5 wt %, Cr: 0.1–1.0 wt %, and Bi: 0.001–0.15 wt %.

EXAMPLE 1

A silicon steel slab was prepared which contains C: 0.073 wt %, Si: 3.43 wt %, Mn: 0.069 wt %, acid-soluble Al: 0.026 wt %, N: 0.0091 wt %, Se: 0.018 wt %, Cu 0.10 wt %, Sb: 0.044 wt %, Cr: 0.30 wt %, and Bi: 0.040 wt %. This slab was heated at 1430° C. for 30 minutes and then hot-rolled into a 2.7-mm thick sheet. The hot-rolled sheet was annealed at 1000° C. for 1 minute. The annealed sheet was cold-rolled into a 1.8-mm thick sheet. The cold-rolled sheet underwent intermediate annealing at 1050° C. for 1 minute. The annealed sheet was cold-rolled again into a 0.23-mm thick sheet (final thickness). The cold-rolled sheet underwent decarburization annealing in an atmosphere of $H_2$—$H_2O$—$N_2$ at 850° C. During this decarburization annealing, the rate of heating and the degree of oxidation (in terms of $P(H_2O)/P(H_2)$) in the atmosphere were changed as shown in Table 5. Also, the amount of oxygen was adjusted in the range of 0.25–1.10 g/m$^2$ on one side by controlling the soaking time and the condition of electrolytic degreasing (if carried out) after the final cold rolling (or before the decarburization annealing). The coiled sheet which had undergone decarburization annealing was coated with an annealing separator (in the form of slurry) which is composed of 100 pbw of MgO, 10 pbw of $TiO_2$, and 2 pbw of Sr compound (as Sr). After drying, the coated sheet was annealed in a nitrogen atmosphere at 800° C. This annealing was followed by annealing for secondary recrystallization in an atmosphere composed of 20% nitrogen and 80% hydrogen, with the temperature raised up to 1150° C. at at a rate of 20° C./h. The steel was finally subjected to purification annealing in an atmosphere of hydrogen at 1200° C. for 5 hours. After this finishing annealing, the steel was given a coating composed mainly of magnesium phosphate and colloidal silica.

The thus obtained product was examined for magnetic properties (magnetic flux density $B_8$ and iron loss $W_{17/50}$) and coating properties (bending adhesion and appearance). The results are shown in Table 5.

It is noted from Table 5 that the samples had forsterite coating of very good quality despite the common belief that it is difficult to form a coating film with good adhesion on a Bi-containing steel. The results of thin film X-ray diffractometry indicate that these good samples had a ratio of intensity ($I_1/I_0$) in the range of 0.2–1.5, where $I_1$ is the peak intensity due to (202) plane of $FeCr_2O_4$ or $Fe_xMn_{1-x}Cr_2O_4$ ($0.6 \leqq x \leqq 1$) and $I_0$ is the peak intensity due to (130) plane of fayalite oxide.

TABLE 5

| Run No. | Rate of heating during decarburization annealing (° C./s) | | | $P(H_2O)/P(H_2)$ in heating zone during decarburization annealing | $P(H_2O)/P(H_2)$ in soaking zone during decarburization annealing | Amount of oxygen after decarburization annealing (g/m$^2$) | Appearance of coating film | Bending adhesion (mm) | Magnetic properties $B_8$ (T) | Iron loss $W_{17/50}$ (W/kg) |
|---|---|---|---|---|---|---|---|---|---|---|
| | Room temp. to 700° C. | 700° C. to 800° C. | 800° C. to 850° C. | | | | | | | |
| Note - Comparative Examples | | | | | | | | | | |
| 1 | 25 | 25 | 15 | 0.50 | 0.60 | 0.67 | X | 45 | 1.918 | 1.023 |
| 2 | 30 | 20 | 10 | 0.40 | 0.50 | 0.57 | Δ | 30 | 1.947 | 0.842 |

TABLE 5-continued

| Run No. | Rate of heating during decarburization annealing (° C./s) Room temp. to 700° C. | 700° C. to 800° C. | 800° C. to 850° C. | $P(H_2O)/P(H_2)$ in heating zone during decarburization annealing | $P(H_2O)/P(H_2)$ in soaking zone during decarburization annealing | Amount of oxygen after decarburization annealing ($g/m^2$) | Appearance of coating film | Bending adhesion (mm) | Magnetic properties $B_8$ (T) | Iron loss $W_{17/50}$ (W/kg) |
|---|---|---|---|---|---|---|---|---|---|---|
| 3 | 40 | 20 | 5 | 0.45 | 0.45 | 0.58 | Δ | 30 | 1.943 | 0.864 |
| 4 | 10 | 5 | 1 | 0.20 | 0.30 | 0.25 | Δ | 40 | 1.920 | 0.978 |
| 5 | 60 | 20 | 5 | 0.30 | 0.40 | 0.52 | Δ | 30 | 1.939 | 0.887 |
| 6 | 30 | 15 | 0.5 | 0.35 | 0.45 | 0.43 | Δ | 35 | 1.941 | 0.879 |
| 7 | 40 | 40 | 5 | 0.15 | 0.40 | 0.73 | Δ | 40 | 1.932 | 0.947 |
| 8 | 30 | 15 | 5 | 0.30 | 0.40 | 0.32 | Δ | 30 | 1.945 | 0.855 |
| 9 | 25 | 10 | 5 | 0.30 | 0.50 | 1.10 | Δ | 35 | 1.934 | 0.931 |
| 10 | 35 | 15 | 3 | 0.50 | 0.60 | 1.00 | X | 45 | 1.915 | 1.040 |
| 11 | 20 | 20 | 20 | 0.35 | 0.45 | 0.52 | Δ | 35 | 1.936 | 0.923 |
| 12 | 15 | 15 | 15 | 0.40 | 0.40 | 0.51 | Δ | 35 | 1.938 | 0.910 |
| | | | | | Note - Working Examples | | | | | |
| 13 | 35 | 15 | 5 | 0.30 | 0.45 | 0.57 | ○ | 20 | 1.973 | 0.752 |
| 14 | 50 | 20 | 7 | 0.30 | 0.35 | 0.43 | ○ | 25 | 1.965 | 0.782 |
| 15 | 25 | 25 | 9 | 0.35 | 0.40 | 0.90 | ○ | 25 | 1.961 | 0.793 |
| 16 | 10 | 10 | 3 | 0.15 | 0.30 | 0.40 | ○ | 25 | 1.963 | 0.789 |
| 17 | 40 | 10 | 0.5 | 0.15 | 0.35 | 0.64 | ○ | 25 | 1.960 | 0.790 |
| 18 | 20 | 20 | 5 | 0.40 | 0.50 | 0.78 | ○ | 25 | 1.962 | 0.782 |
| 19 | 25 | 15 | 3 | 0.35 | 0.45 | 0.38 | ○ | 25 | 1.967 | 0.767 |
| 20 | 15 | 15 | 5 | 0.35 | 0.45 | 0.58 | ○ | 20 | 1.971 | 0.758 |

Criteria for the appearance of forsterite coating film
○: almost uniform, Δ: defective, with the iron underneath partly exposed, X: defective, with the iron underneath markedly exposed

EXAMPLE 2

A silicon steel slab D was prepared which contains C: 0.065 wt %, Si: 3.39 wt %, Mn: 0.067 wt %, acid-soluble Al: 0.025 wt %, N: 0.008 wt %, Se: 0.018 wt %, Cu: 0.10 wt %, Sb: 0.041 wt %, Cr: 0.86 wt %, and Bi: 0.021 wt % and a slab F which contains c: 0.060 wt %, Si: 3.30 wt %, Mn: 0.140 wt %, acid-soluble Al: 0.027 wt %, N: 0.0087 wt %, Cu: 0.02 wt %, Sn: 0.05 wt %, Cr: 0.25 wt % and Bi: 0.017 wt % were prepared. This slab was heated at 1430° C. for 30 minutes and then hot-rolled into a 2.5-mm thick sheet. The hot-rolled sheet was annealed at 1000° C. for 1 minute. The annealed sheet was cold-rolled into a 1.7-mm thick sheet. The cold-rolled sheet underwent intermediate annealing at 1100° C. for 1 minute. The annealed sheet was cold-rolled again into a 0.23-mm thick sheet (final thickness). The cold-rolled sheet underwent decarburization annealing in an atmosphere of $H_2$—$H_2O$—$N_2$ at 840° C. During this decarburization annealing, the rate of heating and the degree of oxidation (in terms of $P(H_2O)/P(H_2)$) in the atmosphere were changed as shown in Table 6. Also, the amount of oxygen was adjusted in the range of 0.35–0.95 $g/m^2$ on one side by controlling the soaking time and the condition of electrolytic degreasing (if carried out) after the final cold rolling (or before the decarburization annealing). The coiled sheet which had undergone decarburization annealing was coated with an annealing separator (in the form of slurry) which is composed mainly of MgO. After drying, the coated sheet underwent finishing annealing, which consists of heating at 850° C. for 20 hours in a nitrogen atmosphere, heating up to 1150° C. at a rate of 15° C./h in an atmosphere composed of 25% nitrogen and 75% hydrogen, and purification annealing (for secondary recrystallization) in hydrogen at 1200° C. for 5 hours. After this finishing annealing, the steel sheet was given a coating composed mainly of magnesium phosphate and colloidal silica.

The thus obtained product was examined for magnetic properties (magnetic flux density $B_8$ and iron loss $W_{17/50}$) and coating properties (bending adhesion and appearance). The results are shown in Table 6.

It is apparent from Table 6 that the samples pertaining to the present invention had good coating properties and magnetic properties. The results of thin film X-ray diffractometry indicate that these good samples have a ratio of intensity ($I_1/I_0$) in the range of 0.2–1.5, where $I_1$ is the peak intensity due to (202) plane of $FeCr_2O_4$ or $Fe_xMn_{1-x}Cr_2O_4$ ($0.6 \leqq x \leqq 1$) and $I_o$ is the peak intensity due to (130) plane of fayalite oxide.

TABLE 6

| Run No. | Steel code | Rate of heating during decarburization annealing (° C./s) Room temp. to 700° C. | 700° C. to 790° C. | 790° C. to 840° C. | $P(H_2O)/P(H_2)$ in heating zone during decarburization annealing | $P(H_2O)/P(H_2)$ in soaking zone during decarburization annealing | Appearance of coating film | Bending adhesion (mm) | Magnetic properties $B_8$ (T) | Iron loss $W_{17/50}$ (W/kg) | Note |
|---|---|---|---|---|---|---|---|---|---|---|---|
| 1 | D | 20 | 20 | 20 | 0.45 | 0.55 | X | 45 | 1.916 | 1.031 | Comparative |
| 2 | D | 15 | 15 | 15 | 0.45 | 0.45 | Δ | 35 | 1.924 | 0.955 | Examples |
| 3 | D | 25 | 25 | 3 | 0.45 | 0.50 | ○ | 25 | 1.960 | 0.762 | Working Example |
| 4 | F | 40 | 30 | 15 | 0.50 | 0.60 | X | 45 | 1.930 | 0.966 | Comparative |

TABLE 6-continued

| Run No. | Steel code | Rate of heating during decarburization annealing (° C./s): Room temp. to 700° C. | 700° C. to 790° C. | 790° C. to 840° C. | $P(H_2O)/P(H_2)$ in heating zone during decarburization annealing | $P(H_2O)/P(H_2)$ in soaking zone during decarburization annealing | Appearance of coating film | Bending adhesion (mm) | Magnetic properties $B_8$ (T) | Iron loss $W_{17/50}$ (W/kg) | Note |
|---|---|---|---|---|---|---|---|---|---|---|---|
| 5 | F | 5 | 5 | 5 | 0.30 | 0.40 | Δ | 30 | 1.941 | 0.870 | Examples |
| 6 | F | 25 | 15 | 3 | 0.35 | 0.45 | ○ | 25 | 1.963 | 0.784 | Working Example |

Criteria for the appearance of forsterite coating film
○: almost uniform, Δ: defective, with the iron underneath partly exposed, X: defective, with the iron underneath markedly exposed

EXAMPLE 3

A silicon steel slab was prepared which contains C: 0.065 wt %, Si 3.45 wt %, Mn: 0.069 wt %, acid-soluble Al: 0.025 wt %, N: 0.0090 wt %, Se: 0.020 wt %, Cu: 0.10 wt %, Sb: 0.043 wt %, Ni: 0.2 wt %, Bi: 0.035 wt %, and Cr: 0.18 wt %. This slab was heated at 1430° C. for 30 minutes and then hot-rolled into a 2.5-mm thick sheet. The hot-rolled sheet was annealed at 1000° C. for 1 minute. The annealed sheet was cold-rolled into a 1.7-mm thick sheet. The cold-rolled sheet underwent intermediate annealing at 1100° C. for 1 minute. The annealed sheet was cold-rolled again into a 0.23-mm thick sheet (final thickness). The cold-rolled sheet underwent decarburization annealing in an atmosphere of $H_2$—$H_2O$—$N_2$ at 830° C. During this decarburization annealing, the rate of heating was varied in the range of 8–50° C./s for heating from room temperature to 750° C. and the rate of heating was varied in the range of 0.2–30° C./s for heating from 750° C. to 830° C., and the degree of oxidation (in terms of $P(H_2O)/P(H_2)$) in the atmosphere in the soaking zone was varied in the range of 0.2–0.7. Also, the amount of oxygen was adjusted in the range of 0.4–0.8 g/m$^2$ on one side by controlling the soaking time and the condition of electrolytic degreasing (if carried out) after the final cold rolling (or before the decarburization annealing). The coiled sheet which had undergone decarburization annealing was coated with an annealing separator (in the form of slurry) which is composed of 100 pbw of MgO, 9 pbw of $TiO_2$, and 3 pbw of $Sr(OH)_2.8H_2O$. After drying, the coated sheet underwent finishing annealing, which consists of heating up to 850° C. in a nitrogen atmosphere, heating up to 1150° C. at a rate of 15° C./h in an atmosphere composed of 20% nitrogen and 80% hydrogen (for secondary recrystallization), and purification annealing in hydrogen at 1200° C. for 5 hours. After this finishing annealing, the steel sheet was given a coating composed mainly of magnesium phosphate and colloidal silica.

The thus obtained product was examined for magnetic properties (magnetic flux density $B_8$ and iron loss $W_{17/50}$) and coating properties (bending adhesion and appearance). The results are shown in Table 7. It is noted from Table 7 that the samples pertaining to the present invention had good coating properties and magnetic properties.

TABLE 7

| Run No. | Rate of heating during decarburization annealing (° C./s): Room temp. to 750° C. | 750° C. to 830° C. | $P(H_2O)/P(H_2)$ in soaking zone during decarburization annealing | Appearance of coating film | Bending adhesion (mm) | Magnetic properties $B_8$ (T) | $W_{17/50}$ (W/kg) | Note |
|---|---|---|---|---|---|---|---|---|
| 1 | 15 | 15 | 0.2 | X | 60 up | 1.924 | 1.164 | Comparative Example |
| 2 | 50 | 10 | 0.3 | Δ | 45 | 1.934 | 1.085 | Comparative Example |
| 3 | 20 | 0.2 | 0.4 | Δ | 40 | 1.941 | 1.011 | Comparative Example |
| 4 | 8 | 3 | 0.5 | ⊙ | 20 | 1.945 | 0.912 | Comparative Example |
| 5 | 20 | 30 | 0.6 | X | 60 up | 1.920 | 1.187 | Comparative Example |
| 6 | 15 | 3 | 0.4 | ⊙ | 15 | 1.985 | 0.720 | Working Example |

Criteria for the appearance of forsterite coating film
⊙: completely uniform,
○: almost uniform,
Δ: whitish coating, with the iron underneath not exposed,
X: whitish coating, with the iron underneath partly exposed.

EXAMPLE 4

A silicon steel slab was prepared which had a composition as shown in Table 8. This slab was heated at 1430° C. for 30 minutes and then hot-rolled into a 2.3-mm thick sheet. The hot-rolled sheet was annealed at 1000° C. for 1 minute. The annealed sheet was cold-rolled into a 1.6-mm thick sheet. The cold-rolled sheet underwent intermediate annealing at 1050° C. for 1 minute. The annealed sheet was cold-rolled again into a 0.23-mm thick sheet (final thickness). The cold-rolled sheet underwent decarburization annealing in an atmosphere of $H_2$—$H_2O$—$N_2$ at 840° C. During this decarburization annealing, the rate of heating was varied in the range of 8–50C./s for heating from room temperature to 750° C. and the rate of heating was varied in the range of 0.2–15° C./s for heating from 750° C. to 840° C., and the degree of oxidation (in terms of $P(H_2O)/P(H_2)$) in the atmosphere in the soaking zone was varied in the range of 0.2–0.7. Also, the amount of oxygen was adjusted in the range of 0.4–1.00 g/m$^2$ on one side by controlling the soaking time and the condition of electrolytic degreasing (if carried out) after the final cold rolling (or before the decarburization annealing). The coiled sheet which had undergone decarburization annealing was coated with an annealing separator (in the form of slurry) which is composed mainly of MgO. After drying, the coated sheet underwent finishing annealing, which consists of heating at 870° C. for 25 hours in a nitrogen atmosphere, heating up to 1150° C. at a rate of 15° C./h in an atmosphere composed of 25% nitrogen and 75% hydrogen (for secondary recrystallization), and purification annealing in hydrogen at 1200° C. for 5 hours. After this finishing annealing, the steel sheet was given a coating composed mainly of magnesium phosphate and colloidal silica.

The thus obtained product was examined for magnetic properties (magnetic flux density $B_8$ and iron loss $W_{17/50}$) and coating properties (bending adhesion and appearance). The results are shown in Table 9. It is noted from Table 9 that the samples pertaining to the present invention had good coating properties and magnetic properties.

Effect of the Invention

As mentioned above, the present invention creates a grain-oriented silicon steel that has superior coating properties and magnetic properties by performing decarburization annealing in such a way that the subscale oxide film that occurs during annealing contains a Cr spinel oxide composed mainly of $FeCr_2O_4$ or $Fe_xMn_{1-x}Cr_2O_4$ ($0.6 \leqq x \leqq 1$), despite the common belief that it is difficult to form a forsterite coating film of good quality on a Bi-containing grain-oriented silicon steel sheet.

What is claimed is:

1. A grain-oriented silicon steel containing Cr and Bi as steel constituents and having a forsterite coating on its surface, wherein said steel and said forsterite coating combined together contain about C≦30 wtppm, Si: 2.0–4.5 wt %, Al: 0.005–0.03 wt %, N: 0.0015–0.006 wt %, Mn: 0.02–0.5 wt %, Cr: 0.1–1.0 wt %, and Bi: 0.001–0.15 wt %, and wherein the steel sheet has a magnetic flux density of $B_8 \geqq 1.96T$.

2. A decarburization annealed silicon steel sheet having a chromium spinel sub-scale, wherein said sheet and sub-scale comprise about C≦30 wtppm, Si: 2.0–4.5 wt %, Al: 0.01–0.05 wt %, N: 0.003–0.012 wt %, Mn: 0.02–0.5 wt %, Cr: 0.1–1.0 wt %, and Bi: 0.005–0.20 wt %.

3. The steel sheet defined in cliam 2, wherein said subscale comprises 0.35 –0.95 $g/m^3$ of oxygen.

4. The steel sheet defined in claim 2, having a chromium-spinel layer having a peak intensity layer $I_1$ due to the (202) plane of $FeCr_2O_4$, as compared to the peak intensity layer $I_0$ of fayalite, wherein the ratio $I_1/I_0$ is 0.2 –0.5.

* * * * *

UNITED STATES PATENT AND TRADEMARK OFFICE

CERTIFICATE OF CORRECTION

PATENT NO. : 6,475,304 B2
DATED : November 5, 2002
INVENTOR(S) : Toda et al.

It is certified that error appears in the above-identified patent and that said Letters Patent is hereby corrected as shown below:

Title page,
Item [54], Title, please delete "AND PROCESS FOR PRODUCTION THEREOF"

Column 3,
Line 34, please insert -- a -- before "forsterite".

Column 4,
Line 18, please insert -- a -- before "forsterite".

Column 6,
Line 10, please insert -- the -- before "(202)".

Column 8,
Line 45, please change "zone is" to -- zone was --.

Column 10,
Line 63, please insert -- the -- before "subscale".

Column 11,
Line 52, please change "wt[}]ps" to -- wt% --.

Column 14,
Line 8, please insert -- subsequently -- before "coated".

Column 16,
Table 3, at No. 1, at the subheading $MoO_2$, please change "20" to -- 0 --.

UNITED STATES PATENT AND TRADEMARK OFFICE

CERTIFICATE OF CORRECTION

PATENT NO. : 6,475,304 B2 
DATED : November 5, 2002
INVENTOR(S) : Toda et al.

It is certified that error appears in the above-identified patent and that said Letters Patent is hereby corrected as shown below:

Column 23,
Please insert Table 8 and 9 as follows:

Table 8

(wt%)

| Code | C | Si | Mn | Se | S | Acid-soluble Al | N | Sb | Bi | Cu | Added components |
|---|---|---|---|---|---|---|---|---|---|---|---|
| YC | 0.072 | 3.45 | 0.072 | 0.019 | – | 0.026 | 0.0088 | 0.045 | 0.021 | 0.10 | Ni = 0.2<br>Cr = 0.25 |
| YD | 0.070 | 3.25 | 0.070 | – | 0.018 | 0.025 | 0.0082 | 0.025 | 0.035 | 0.12 | Sn = 0.12<br>Cr = 0.12 |

Table 9

| Run No. | Steel code | Rate of heating during decarburization annealing (°C/s) | | $P(H_2O)/P(H_2)$ in soaking zone during decarburization annealing | Appearance of coating film | Bending adhesion (mm) | Magnetic properties | | Note |
|---|---|---|---|---|---|---|---|---|---|
| | | Room temp. to 750°C | 750°C to 830°C | | | | $B_8$ (T) | $W_{17/50}$ (W/kg) | |
| 1 | YC | 50 | 10 | 0.2 | △ | 50 | 1.933 | 1.070 | Comparative Example |
| 2 | YC | 20 | 20 | 0.35 | × | 60 up | 1.922 | 1.172 | Comparative Example |
| 3 | YC | 15 | 3 | 0.45 | ◎ | 15 | 1.984 | 0.731 | Working Example |
| 4 | YD | 8 | 15 | 0.35 | × | 45 | 1.925 | 1.150 | Comparative Example |
| 5 | YD | 20 | 8 | 0.45 | ◎ | 15 | 1.980 | 0.740 | Working Example |

Criteria for the appearance of forsterite coating film
◎ : completely uniform,
○ : almost uniform,
△ : whitish coating, with the iron underneath not exposed,
× : whitish coating, with the iron underneath partly exposed.

Column 24,
Line 25, please change "0.2-0.5" to -- 0.2-1.5 --.

Signed and Sealed this

Second Day of November, 2004

JON W. DUDAS
*Director of the United States Patent and Trademark Office*